United States Patent [19]

Rabska

[11] Patent Number: 4,858,797

[45] Date of Patent: Aug. 22, 1989

[54] FIRE HOSE BACKPACK FRAME

[76] Inventor: William G. Rabska, 502 Kinglet Ct., Suisun City, Calif. 94585

[21] Appl. No.: 150,826

[22] Filed: Feb. 1, 1988

[51] Int. Cl.[4] ..... B65H 75/40; B65D 83/04

[52] U.S. Cl. ..... 224/162; 224/196; 224/211; 224/250; 224/255; 242/86

[58] Field of Search ..... 224/162, 185, 191, 196, 224/197, 201, 202, 204, 205, 207, 208, 209, 211, 210, 212, 213, 214, 215, 216, 250, 255, 265, 266, 270; 242/86, 96; 244/149

[56] References Cited

U.S. PATENT DOCUMENTS

| | | | |
|---|---|---|---|
| 3,258,220 | 6/1966 | Munger | 242/96 |
| 3,722,823 | 3/1973 | Reich et al. | 224/162 |
| 4,114,788 | 9/1978 | Zufich | 224/211 |
| 4,518,107 | 5/1985 | Amos | 224/901 |

FOREIGN PATENT DOCUMENTS

| | | | |
|---|---|---|---|
| 733732 | 3/1943 | Fed. Rep. of Germany | 244/149 |
| 988108 | 4/1951 | France | 224/210 |
| 474582 | 9/1952 | Italy | 224/210 |
| 75830 | 10/1949 | Norway | 224/212 |
| 1081588 | 8/1982 | U.S.S.R. | 224/162 |
| 17034 | 12/1915 | United Kingdom | 224/162 |
| 268498 | 4/1927 | United Kingdom | 244/149 |

*Primary Examiner*—Henry J. Recla
*Assistant Examiner*—J. Casimer Jacyna
*Attorney, Agent, or Firm*—John J. Leavitt

[57] ABSTRACT

Presented is a backpack for use in carrying hose, such as fire hose, to locations where it is needed. The backpack includes a rigid metallic frame having at one end a hose support shelf on which at least two spirally coiled rolls of fire hose may be carried. Quickly engageable and releasable straps are provided to bind the coils of fire hose to the back frame, and shoulder straps and a waist strap are provided to suspend the backpack on the back of the wearer. All that is required of the wearer to release and deploy one or more coils of hose from the backpack is to tug on one end of a flexible cable, with the result that the quick-release straps that bind the coils to the frame are released, thus enabling the coils of hose to be deployed by a mere shrug of the shoulders.

16 Claims, 4 Drawing Sheets

FIRE HOSE BACKPACK FRAME

BACKGROUND OF THE INVENTION

1. Field of the Invention.

This invention relates to pack frames, and more particularly to a type of pack frame adapted to be supported on the back of a human wearer, and particularly adapted for the carrying and deployment of coiled fire hose.

2. Description of the the Prior Art.

A preliminary patentability and novelty search conducted in connection with this invention has revealed the existence of U.S. Pat. Nos. 2,717,129; 3,258,220; 3,637,158 and 3,722,823.

U.S. Pat. No. 2,717,129 relates to a pack frame, but does not relate to a pack frame that is suitable for carrying coiled fire hose. The subject matter of this patent relates to a portable reel driven by a hand-operated handle through a pair of sprockets connected by a chain to rotate the reel. The reel is used to take up such things as cable, wire, or other elongated members, perhaps rope, that are intended to be laid out for long distances and then to be re-wound for re-use.

U.S. Pat. No. 3,258,220, like the previous patent discussed above, is shoulder-mounted and is provided with a rearwardly extending member on which is pivotally mounted a spool on which wire may be wound. There is no suggestion in this patent that the structure may be used to carry a coiled fire hose.

U.S. Pat. No. 3,636,158 relates to a reeling apparatus for Army cable, and does not pertain to fire hose.

U.S. Pat. No. 3,722,823 is the only patent out of the four noted above that relates to a fire hose pack frame. Basicly, the structure includes shoulder straps for supporting the frame, and includes a back frame on which is mounted a generally rectangular auxiliary frame on the upper rear corner of which is journaled a reel on which a fire hose may be wound. While the structure relates to fire hose, and a backpack frame for carrying such fire hose, there is almost no similarity in structure between the subject matter of U.S. Pat. No. 3,722,823 and the instant invention.

Down through the course of history, pack frames have been designed to carry most things, even people. However, there appears to be a dearth of pack frames to carry fire hose, and this is surprising because there is a very definite and urgent need for fire hose to be carried from the transportation vehicle to the scene of a fire where the fire hose may be coupled to a hydrant or to another hose. In many instances, where a fire hose is already coupled to the fire hydrant, there is still the necessity that additional lengths of hose be available to carry water or other extinguishant to remote "hot spots" that cannot be reached with a single hose. In these instances, given the urgency of the situation, the word is passed by radio, usually, that additional lengths of hose be delivered to the location where it is needed. A fireman then must deliver the hose requested.

In discussing with firemen the many problems inherent in fighting a fire, it has been revealed that one method of carrying a pair of hoses, say of one hundred feed each, that have previously been coiled and bound into such coiled form by straps that extend through the center of the hose coil and which continue radially outwardly and around the periphery, usually at diametrically opposed locations, is to grasp the free ends of the hoses and drape them over the shoulders on opposite sides of the neck so that both coils of hose hang behind the fireman while he grasps the ends of the hoses at about chest height. One of the disadvantages of this method is that if the coil is not tightly bound, there is no assurance that the coiled hose is not going to unravel as the fireman rushes along with the hoses dangling behind him. Additionally, as the fireman runs with the firehoses hanging behind him, even if they do not unravel, the coils swing from side-to-side, bump against the back of the fireman, and the ends of the hoses draped over the shoulders tend to slip off the shoulder, thus causing an interruption in the effort to transport the hoses, and using time that cannot be spared, particularly in a dangerous environment. An additional problem with this practice of carrying extra coils of fire hose, is than when the fireman reaches his destination with the hose, assuming that the coils of hose are still intact in coiled and bound form, they must now be unbound by removal of the straps, thus occupying additional time that could be critical.

Another method of carrying fire hose is initiated by laying the hose out flat and then folding it upon itself in about six foot lengths. Since each length of hose is stacked upon the one beneath, they may be bound together with straps, usually three, one at each opposite end and another at about the midpoint of the pack, and the entire bound bundle is then hoisted onto one shoulder or around the neck if only one bundle is being carried, in much the same way that a person would carry a sack of potatoes. However, since the fire hose thus arranged is flexible, it drapes in front of the fireman and drapes behind the fireman, impeding movement, and always has the tendency of slipping from the shoulder. Additionally, since it requires two hands to hoist the hose bundle onto the shoulder, it is extremely difficult for a fireman to carry such bundles of hose, one on each shoulder, for the reason that it is almost impossible to pick up the second bundle of hose when he already has one bundle on his shoulder and must maintain its precarious perch on his shoulder while he stoops to pick up the second bundle of hose.

Accordingly, one of the objects of the present invention is the provision of a pack frame that may be easily slipped onto the back of a fireman and which has mounted thereon a pair of coiled fire hoses each of which is securely bound to the pack frame but each of which may be easily and quickly deployed at will by the fireman when he reaches his destination.

Fire hose is manufactured in fifty, seventy-five and one hundred foot lengths. Such hoses are provided with couplings at each end which may be connected to complementary couplings on the end of another hose, or onto which a fire nozzle may be coupled. Frequently, more than one hundred feet of hose is needed in a given situation. Sometimes as much hose is needed as can be carried by a fireman, e.g., in a wild brush fire, where the source of water is a long distance from the configuration. Accordingly, another object of the invention is the provision of a fire hose backpack frame that will easily releasably support two coils of fire hose of one hundred feet each, thus providing the capacity with a single backpack frame of carrying two hundred feet of fire hose. Shorter lengths may of course be carried in various length combinations as the need may dictate.

To enable the carrying of more than two hundred feet of fire hose, another object of the invention is the provision of a backpack frame that may be grasped by the hand and comfortably carried while suspended from the hand, so that a single fireman can carry two hundred feet of fire hose on his back, and an additional two hundred feet of fire hose in each hand, for a total of six hundred feet of fire hose on three separate backpack frames.

Another object of the invention is the provision of a fire hose backpack frame that can be pre-loaded with two coils of fire hose, and the pack frame appropriately stored on the fire truck or other transport vehicle, ready to be slung onto a fireman's back or grasped for carrying in the hand.

Still another object of the invention is the provision of a fire hose backpack frame which securely retains two coils of fire hose on the frame for carrying purposes, and which incorporates means for quickly and easily deploying single coils of hose from the frame when the fireman reaches specific locations, even while the fireman is on the run between separate and spaced locations where such coils must be deployed, there being no necessity for the fireman to even pause to deploy a coil of hose where it is needed, and there being no need for the firemen who are to use the coil of hose to untie straps or remove bindings.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the fire hose backpack frame of the invention comprises a generally trapezoidal member formed from steel or other suitable material, the upper end of which constitutes a transverse bar joining two non-parallel side arms of the trapezoidal member, and forming a hand-hold, while the lower ends of the arms are joined by a transversely extending bar parallel to the upper transverse bar. The lower ends of the arms are spread more widely than the upper ends of the side arms. Intermediate bars parallel to each other and to the upper and lower parallel bars are provided connected between the two non-parallel side arms. Mounted on the lower end of the trapezoidal frame member is a cantilever frame member which functions as a shelf to support at least two coils of fire hose. Suitably mounted on the frame assembly is a shoulder strap assembly that is adapted to slip over the shoulders of the wearer, the strap assembly draping down over the chest of the wearer and being provided with appropriate buckles for adjustment purposes. Additionally, a waist strap assembly is provided adapted to circumscribe the waist of the wearer and to retain the lower end of the pack frame snugly against the back of the wearer. Adapted to retain the fire hose supported on the shelf-like cantilever frame member is a fire hose retention assembly including a plurality of two-part straps opposite ends of which are secured to selected ones of the intermediate bars of the frame while the other ends of the straps are equipped with quick release fastener means so that each individual coil of fire hose may be securely bound to the frame. Means are also provided mounted on the frame manipulable by the wearer of the backpack to release individually each of the coils being carried so that each coil may be deployed independently at the location where it is needed.

DESCRIPTION OF THE PREFERRED EMBODIMENT

Figure 1:
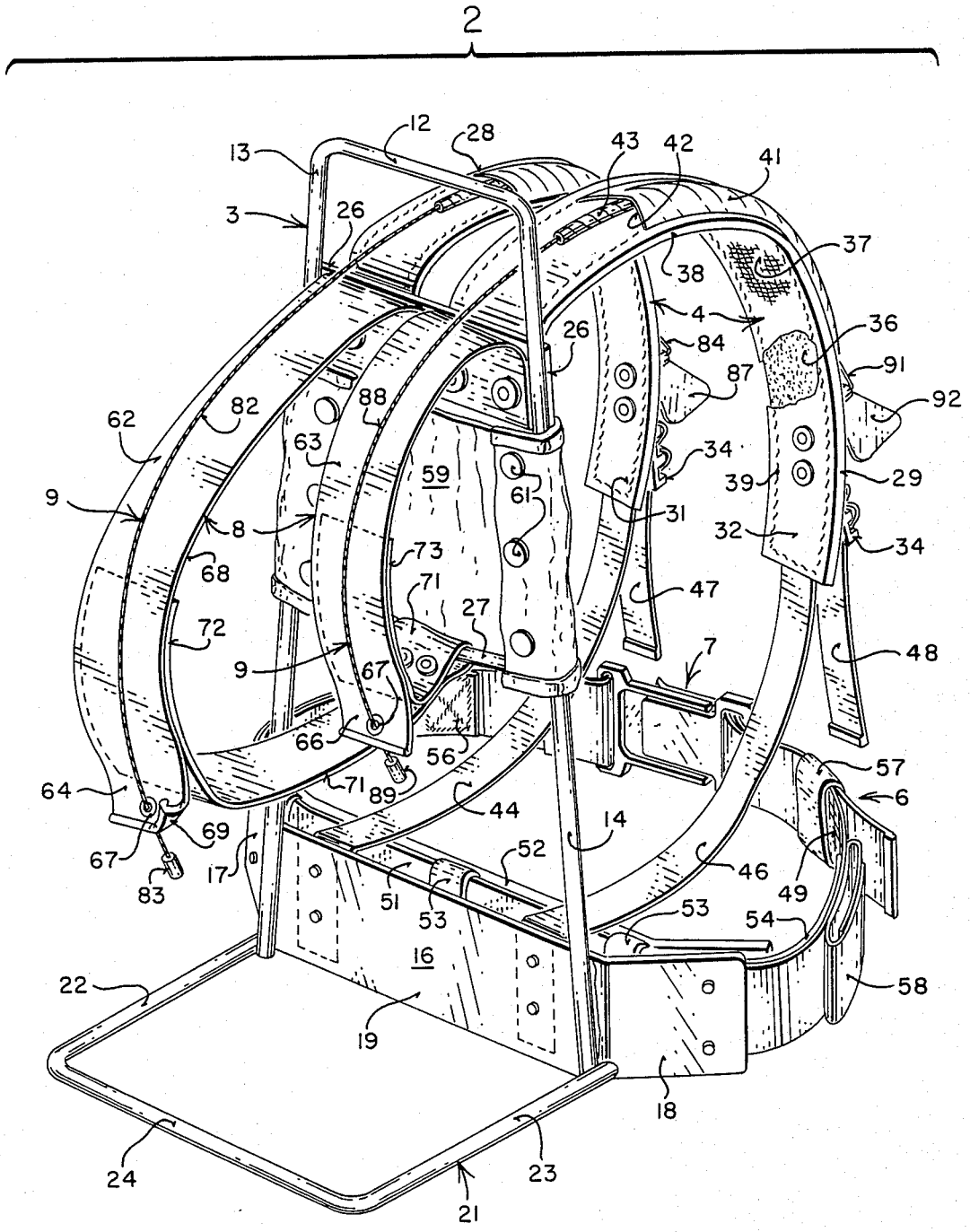
FIG. 1 is a perspective view showing the fire hose backpack assembly apart from any other structure and prior to the placement of coils of hose thereon.

In terms of greater detail, the fire hose backpack of the invention is designated generally by the numeral 2 and comprises a back frame assembly designated generally by the numeral 3, and constructed of a rigid and strong material such as metal or appropriate synthetic resinous material. Attached to the back frame assembly is a shoulder strap assembly designated generally by the numeral 4, and formed from flexible web-type straps that may be draped over the shoulders of the wearer so that the back frame assembly may rest comfortably and securely on the back of the wearer. To further insure the security of the back frame on the back of the wearer, there is provided a waist strap assembly designated generally by the numeral 6, attached to the lower end of the back frame assembly and adapted to encircle the waist of the wearer and provided with a quick release buckle assembly designated generally by the numeral 7 adjustable on the associated ends of the waist strap to fit the waist strap to the appropriate size of the wearer, and to provide a quick connection and release mechanism for the waist strap assembly.

To support one or more coils of fire hose on the back frame in a manner that they can easily be secured on the back frame and just as easily be released and deployed therefrom while being carried on the back of the wearer, there is provided a fire hose retention assembly on the back frame, designated generally by the numeral 8, and formed from flexible straps having selectively interconnecting and releasable means adapted to be releasably interconnected to secure the coils of fire hose to the back frame, and adapted to be released when it is desired to release the fire hose coils from the back frame to deploy one or more as desired. Also mounted on the back frame and cooperatively associated with the fire hose retention assembly and the shoulder strap assembly is a fire hose release assembly designated generally by the numeral 9 and selectively manipulable by the wearer of the backpack to release one or more of the coils of fire hose being carried.

Referring to FIG. 1, it will be seen that the back frame 3 is depicted as being formed from rigid rod stock, whether it be metal or synthetic material, conveniently in the form of a trapezoid including an upper transverse bar 12 integrally joining the associated ends of diverging side members or arms 13 and 14, the lower end portions of which side arms are integrally joined by a transverse bar 16 formed from flat bar stock, and having end portions 17 and 18 that project beyond the limits of the side arms and which are bent in opposite directions out of the plane of the main body 19 of the flat transverse bar 16. As seen in the drawings, these end portions 17 and 18 are adapted to partially envelop the lumbar region of the wearer's back when the backpack is supported on the wearer's back. The rigid back frame also includes a lower cantilever-like shelf or support member 21 formed from rod stock similar to the material from which the frame side arms are formed and integrally joined to the lower end portions of the side arms and to the flat transverse bar 16 in the regions where the end portions 17 and 18 diverge away from the side arms. It should be noted that the cantilever-like support member is formed from side members 22 and 23 joined at their ends remote from the arms 13 and 14 by a transverse cross member 24 so that the area defined by the side members 22, 23, cross member 24 and the body portion 19 of the bar 16, constitutes a void into which a portion of the outer periphery of a coiled fire hose extends when the coiled fire hose is supported on the cantilever-like support member 21.

The trapezoidal-shaped back frame is also provided with a first intermediate cross-bar 26 spaced from and parallel with the upper transverse bar 12, and a second intermediate cross-bar 27 spaced from and parallel with the first intermediate cross-bar, both of these intermediate cross-bars being integrally welded to the non-parallel side arms 13 and 14 intermediate their ends, and both being parallel with the lower cross-bar 16. It should be noted, however, that the first intermediate cross-bar 26 is formed from flat bar stock similar in thickness to the lower cross-bar 16 but somewhat more narrow and is face-welded between the two side arms on the faces thereof that will lie against the back of the wearer, while the second intermediate cross-bar 27 is formed from cylindrical rod stock similar to the material from which the side arms 13 and 14 are formed and is welded to the mutually facing peripheries of the side arms and is slightly bowed out of the plane of the side arms and in a direction away from the back of the wearer when the backpack is supported on the back of the wearer.

It will thus be seen that the back frame of the backpack is formed in a rigid manner from materials that will withstand hard usage and the imposition of external impact forces of very substantial amounts. Additionally, it will be noted that the configuration of the back frame is such that it lies snugly and comfortably against the back of the wearer, and is sufficiently rigid to support the added weight of one or more coils of fire hose without flexure of the frame or the imposition of painful pressures on the back of the wearer.

Figure 7:
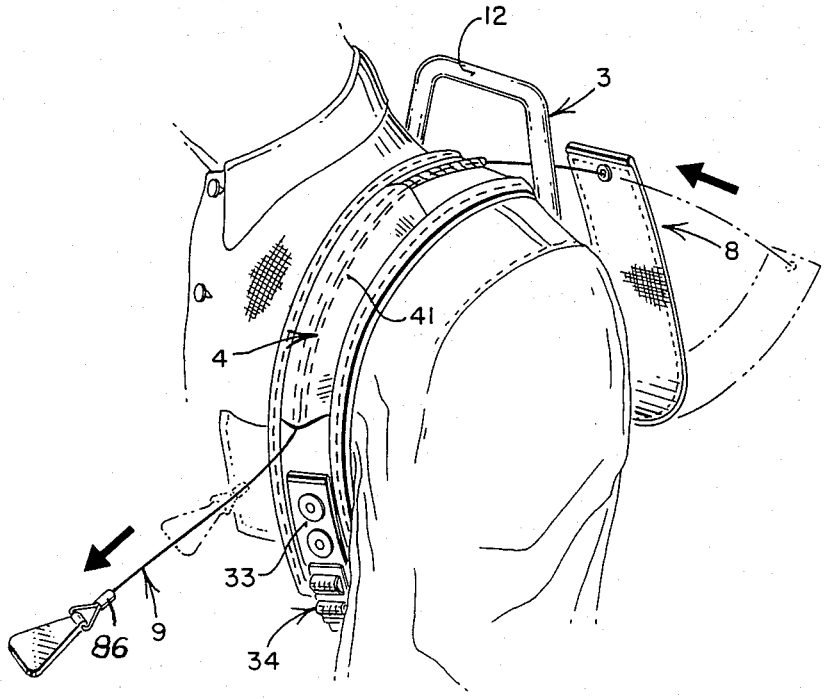
FIG. 7 is a perspective view illustrating the release means by which the initial coil of fire hose is released by the wearer.

Mounted on the frame so as to project or extend on one side of a plane within which the back frame is included, is the shoulder strap assembly 4, formed conveniently from two equal length straps 28 and 29 of flexible webbing material one end of each of which is securely and permanently secured, as by rivets, to the flat bar 26 in spaced parallel relationship as shown. The end portions 31 and 32 of the straps 28 and 29 remote from the rivetted ends are each provided with a narrower strap portion 33 doubled back upon itself and rivetted to the associated strap end portion 31 or 32 to form a loop within which is secured a buckle assembly 34 as shown in FIG. 7.

Additionally, each of the shoulder straps 28 and 29 over its entire length is provided with a strip 36 of cushioning material on the side of each strap that is adapted to impinge on the shoulder and chest of the wearer, the cushioning strip being enclosed within a backing member 37 of fabric, the longitudinal edges 38 of which are folded around the longitudinal edges of the straps 28 and 29 and sewn thereto by appropriate stitching 39 as shown. For a major portion of the length of each shoulder strap, on the side thereof opposite the side on which is sewn the strip of cushioning material, there is also sewn by the same stitching 39 a length of flexible fabric strap 41 adapted to form with the shoulder strap with which it is associated a passageway 42 for a length of tough plastic tubing 43 formed from an elongated strip of such plastic spirally formed into an elongated tube as shown. The tubing 43 is of such length as to project slightly from each end of the passageway 42 formed for it by the overlying flexible fabric strap 41.

To complete the shoulder strap assembly, there is permanently secured to the lower cross-bar 16 a pair of laterally spaced straps 44 and 46, the associated end portions of these straps being arranged adjacent the lower ends of the side arms 13 and 14 and secured to the cross-bar 16 by appropriate rivets as shown. The opposite end portions 47 and 48 of these straps are adapted to be inserted through the buckle assembly 34 (FIG. 7) and doubled back upon themselves through the buckle assembly to securely anchor each of the end portions 47 and 48 to the associated buckle assembly. The buckle assembly also provides for adjustment of the straps 44 and 46 to fit different size wearers of the backpack.

Figure 6:
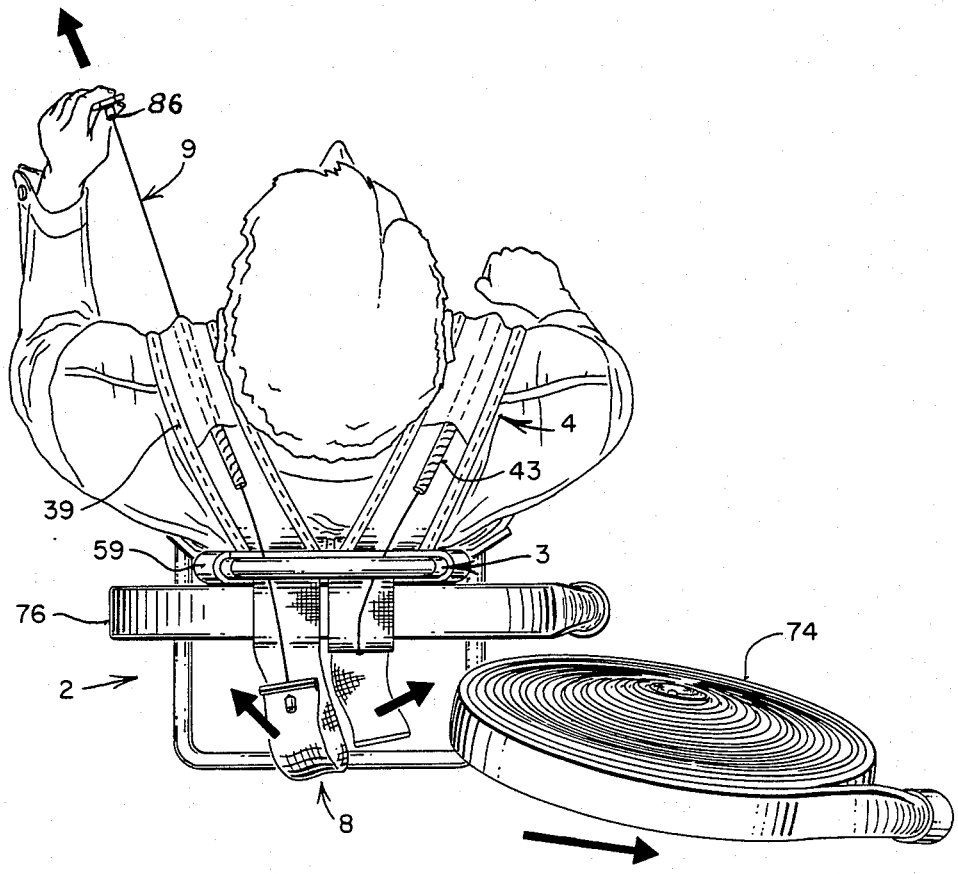
FIG. 6 is a plan view illustrating the release and deployment of the first coil of fire hose as illustrated in FIG. 4.

It will thus be seen that, as shown in FIG. 6, the backpack may be slung onto the back of the wearer with the shoulder straps overlying the shoulders of the wearer on opposite sides of the neck, the ends of the shoulder straps draping down over the chest to a position about midway between the top and bottom of the frame, with the frame lying snugly and comfortably against the wearer's back. This arrangement, without more, suspends the backpack frame on the back of the wearer. However, to ensure immovability of the backpack on the back of the wearer, there is provided the waist strap assembly designated generally by the numeral 6.

Referring to FIG. 1, it will there be seen that the waist strap assembly includes an elongated strap 49, the intermediate portion 51 of which spans the distance between the end portions 17 and 18 of the lower transverse cross-bar 16, and is anchored by rivets to the end portions adjacent their outer ends so that the intermediate portion 51 of the strap 49 extends taut between the anchor points, generally parallel to the associated body portion 19 of the cross-bar 16, and spaced forwardly therefrom so that when the backpack is donned, the intermediate portion 51 of the waist strap prevents the body portion 19 of the lower cross-bar from coming into contact with the lumbar region of the wearer's back. This is important because it shields the wearer from the cross-bar in the event the cross-bar becomes hot by being in close proximity to a fire.

To further thermally insulate the wearer from the effects of heat, and to increase the comfort level of the backpack despite its weight, the intermediate portion 51 of the waist strap is provided with a detachable cushion strip 52 secured by a plurality of loops 53 permanently sewn to the cushioning strip and detachably secured around the strap portion 51 by appropriate fasteners, such as snap fasteners (not shown). The cushioning strip is of sufficient length, as shown, to extend a short distance beyond the ends of the outwardly flared end portions 17 and 18 of the lower cross-bar member 16 to thus form the primary contact with the lumbar region of the wearer. To lend additional strength to the intermediate portion 51 of the waist strap, this portion of the waist strap, extending for some distance beyond the point of attachment of the intermediate portion to the cross-bar 16, is laminated with an additional length of webbing strap 54 that is adhered to the underlying strap 49 by appropriate adhesive and box stitching 56 at opposite ends as shown.

From the points of attachment of the intermediate portion 51 of the waist strap (including the reinforcement strap 54) to the end portions 17 and 18 of the cross-bar 16, the waist strap ends extend forwardly and each end is connected to one portion of two interconnecting buckle portions that make up the buckle assembly 7. From the buckle assembly, the strap ends are doubled back upon themselves and retained in close juxtaposition as shown by appropriate belt loops 57. To lend greater utility to the waist strap assembly, the waist strap is provided with web strap loops 58, here shown to be formed from a length of strap material doubled back upon itself and having the overlapping ends releasably fastened as by the "hook and felt" type fastener commonly referred to as a "Velcro" fastener. Obviously, the utility loops 58 could be formed as a permanent loop through which the handle of a tool could be passed to support the tool by its head on the waist strap.

To provide additional thermal insulation for the wearer, and to prevent chafing of the wearer's back by the coiled fire hose carried on the frame, there is provided on the frame between the first intermediate cross-bar 26 and the second intermediate cross-bar 27 a pad 59 the lateral edge portions of which are folded around the side arms 13 and 14 and secured to the body of the pad by appropriate snap fasteners 61 permanently attached to the pad. The pad is preferably formed from two layers of woven fabric, such as heavy canvas, with an appropriate cushioning material (not shown) disposed between the two layers of woven fabrics.

Again referring to FIG. 1, there is there shown the fire hose retention assembly designated generally by the numeral 8 and including two spaced web straps 62 and 63, the strap 62 being appreciably longer than the strap 63. Each of the straps is anchored at one end by appropriate rivets to the first intermediate cross-bar 26. For purposes of economy and ease of assembly, the same rivets that retain the upper ends of the shoulder straps 28 and 29 to the first intermediate cross-bar may be used to secure the associated ends of the straps 62 and 63 thereto. The opposite end portions 64 and 66, respectively, of the straps 62 and 63, are free ends and each is provided with an eyelet 67 closely adjacent the free end of the strap as shown. Additionally, the underside 68 of each end portion 64 and 66 is provided for a significant length with a strip 69 of the "hook" portion of the releasable fastener known as "Velcro".

Mounted permanently on the second transverse cross-bar 27 is a single strap 71 which is wrapped around the cross-bar and overlapped and rivetted close to the cross-bar, thus leaving the opposite end portions 72 and 73 of the single strap free for releasable engagement with the free end portions 64 and 66, respectively, of the straps 62 and 63. The free end portions 72 and 73 are provided for a portion of their length commencing at their free ends with the "felt" portion of the "hook and felt" releasable fastening means commonly referred to as "Velcro", the end portion 72 being somewhat longer than the end portion 73. Thus, as illustrated in FIG. 1, the free end portions 64/72 may be overlapped and releasably fastened, while the free end portions 66/73 may also be overlapped and releasably fastened.

Figure 2:
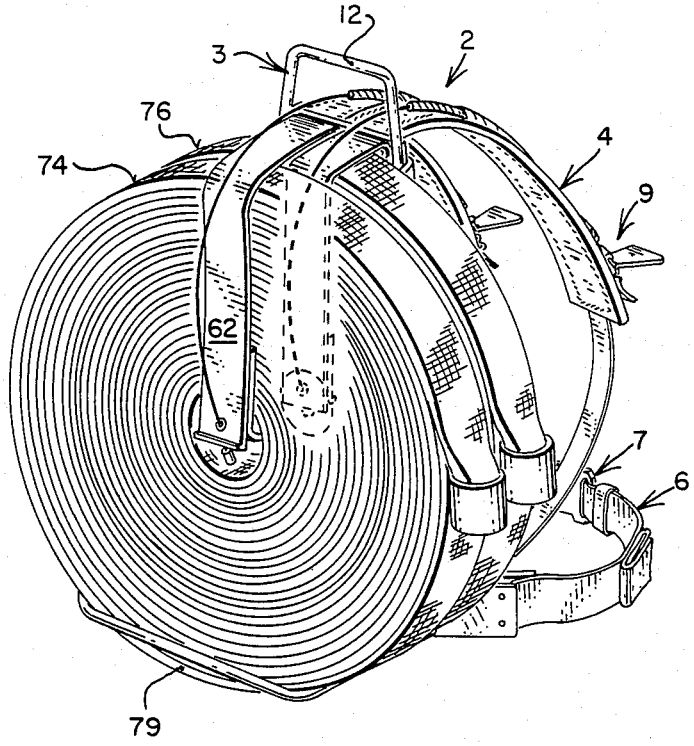
FIG. 2 is a perspective view illustrating the fire hose backpack frame loaded with two coils of fire hose.
Figure 3:
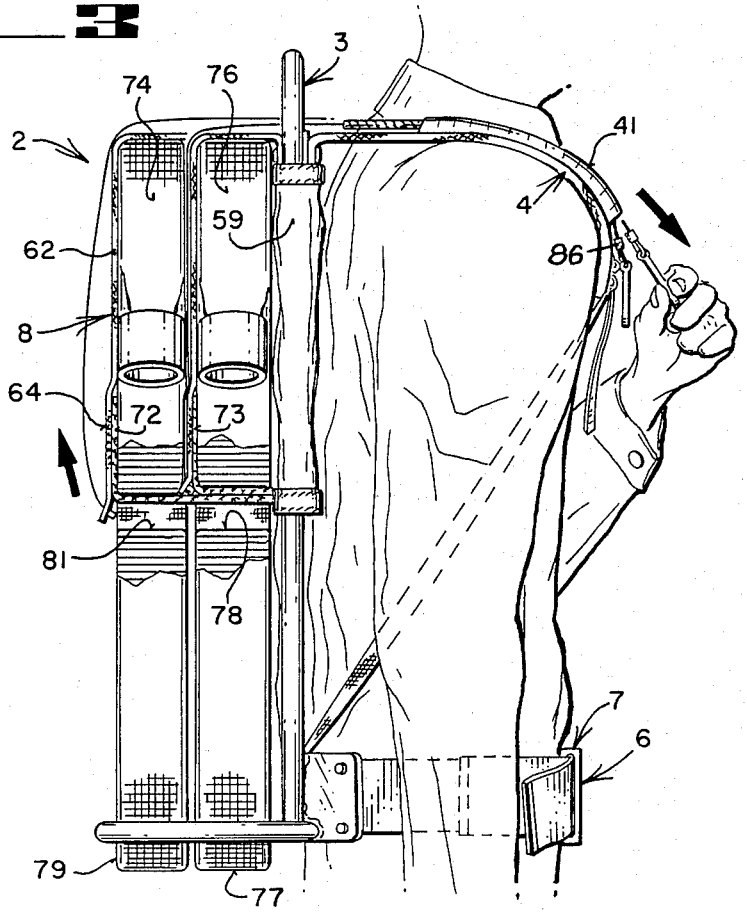
FIG. 3 is a perspective view illustrating the loaded fire hose pack frame supported on the back of a wearer.

As illustrated in FIG. 2, when it is desired to support and releasably secure two coiled fire hoses 74 and 76 on and to the back frame, the first (76) of two coils of fire hose is placed on the cantilever member 21 so that peripheral portion 77 of the hose 76 projects into the void defined by the cantilever member. Concomitantly, the detached end portion 73 of the strap 71 is passed through the central opening 78 of the coiled hose 76, which lies next adjacent the back frame, and is releasably attached to the end portion 66 of the strap 63 which overlies the upper periphery of the coiled hose 76 and crosses radially across the coils of the hose to adjacent the central opening 78, where it overlaps and is releasably secured to the free end portion 73 of the strap 71. The straps 63 and 71 thus form a two-part selectively releasable attachment means for securely releasably fastening the coil 76 to the back frame. In like manner, the coiled hose 74 is releasably secured to the back frame by the cooperative relationship of the strap 62 and the free end portion 72 of the strap 71. In this instance, after placement of the coiled hose 76 on the cantilever member 21 and its releasable attachment to the back frame as discussed above, the second coiled hose 74 is placed on the cantilever member in juxtaposed coaxial relationship with the coiled hose 76 so that the lower peripheral portion 79 of the coil projects into the void defined by the cantilever member, and the strap end portion 72 of the strap 71 is passed through the central opening 78 of the hose coil 76 and also through the central opening 81 of the hose coil 74, the extra length of the strap portion 72 thus permitting its extension through the central openings of both hose coils, and permitting also that the end portion 72 extend radially upwardly parallel with the outer surface of the coil 74, where it is overlapped by the radially extending end portion 64 of the strap 62. The overlapped end portions 64 and 72 releasably engage and thus secure the second hose coil 74 releasably to the back frame.

To effect selective release and deployment of the two coiled hoses, there is provided the fire hose release assembly designated generally by the numeral 9. The fire hose release assembly includes means for selectively and individually releasing each hose coil from the back frame and deploying it whereever it is needed. Structurally, the hose release mechanism for releasing the hose coil 74 comprises an elongated stainless steel wire strand cable 82 which overlies, rests on, and extends between the left shoulder strap 28 and the hose retention strap 62 as shown in the drawings. The cable passes through the eyelet 67 associated with the free end portion 64 of the strap 62, and the free end of the cable is provided with an abutment 83 sized larger than the opening in the eyelet so that the abutment cannot pass therethrough, thus effectively anchoring the end of the cable to the end portion 64 of the strap 62. At its opposite end, the cable passes through the tube 43 contained within the passageway 42, and exits from the tube to be formed into a loop 84 by a sleeve 86 crimped about the doubled back end portion of the cable. A pull tab 87 is attached to the loop 84 and as can be seen from the drawings, is appropriately positioned so that it can be grasped and tugged by either the left or right hand of the wearer.

In like manner, the release mechanism for selectively releasing the fire hose coil 76 includes a similar cable 88 associated with the right shoulder strap 29 and the fire hose retention strap 63. The cable 88 passes over, rests on, and extends between the shoulder strap 29 and the retention strap 63, and at its free end associated with the strap 63 passes through the eyelet 67 associated with the end portion 66 of the strap 63, and is provided with an abutment 89 fastened to the cable end and adapted to abut the eyelet from the underside of the strap 63 when the cable is tugged. The opposite end of the cable 88 passes through the tube 43 and exits the tube to be formed into a loop 91, as before, to which a pull tab 92 is fastened.

Figure 4:
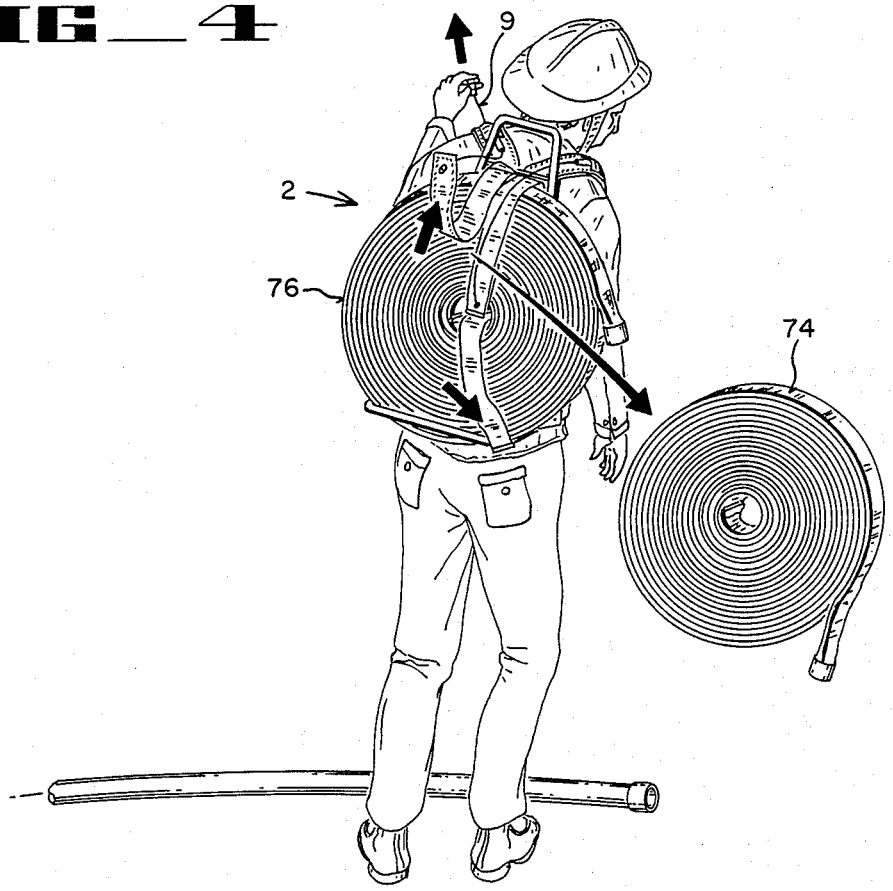
FIG. 4 is a perspective view illustrating the manner of releasing and deploying the first of the two coils of fire hose from the pack frame.

It will thus be seen, as illustrated in FIG. 4, that all that is required to release and deploy the hose coil 74 is that the wearer of the backpack tug on the left pull tab 87, thus tensioning the cable 82, bringing the abutment 83 into engagement with the eyelet 67, and stripping the "hook" end portion 64 of the strap 62 from the underlying "felt" end portion 72 of the strap 71, thus releasing the coiled hose 74 so that it may be deployed to the right as illustrated in FIGS. 4 and 6. Obviously, while I have depicted the hose coil 74 as being deployed to the right, it could just as easily be deployed to the left. Deployment is easily effected by merely shrugging the shoulders in the direction in which it is desired that the coiled hose be deployed.

Figure 5:
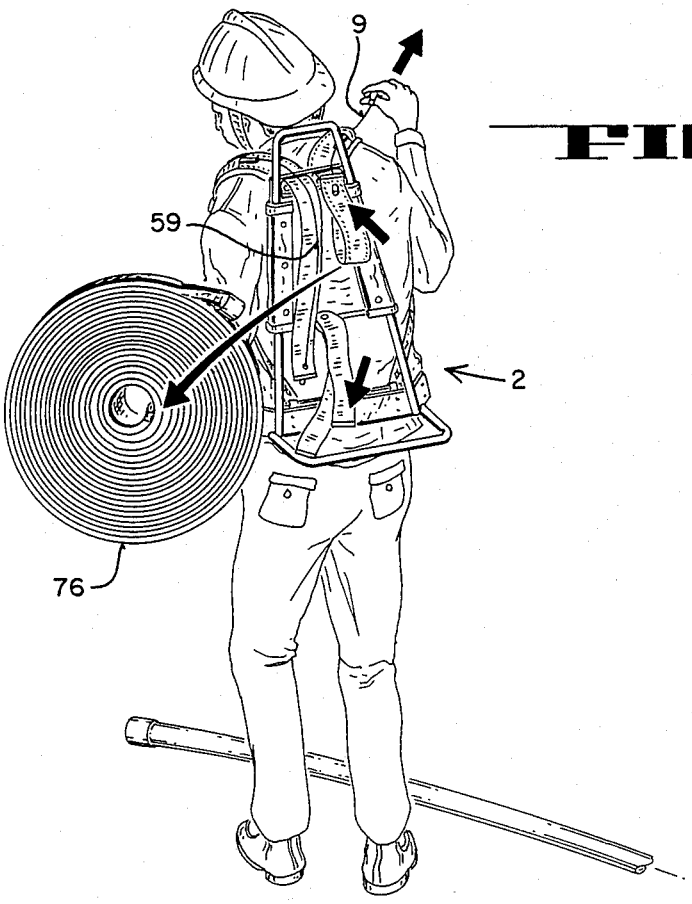
FIG. 5 is a perspective view illustrating the manner of releasing the second coil of fire hose from the pack frame.

In like manner, to release and deploy the coiled hose 76, the wearer, having previously released and deployed the hose coil 74, now tugs on the pull tab 92 attached to the cable 88, thus tensioning the cable 88 and bringing the abutment 89 against the eyelet 67 in the end portion 66 of the strap 63. Continued tension on the cable strips the "hook" end portion 66 from the "felt" end portion 73 of the strap 71, thus releasing the coiled hose 76, which may now be deployed either to the left as illustrated in FIG. 5 or to the right, as may be expedient. After the fire hoses have been extended and used, they are again individually formed into a coil and again releasably mounted on the backpack for immediate use as previously described. So that there can be no mistake as to which "hook" end portion 64 or 66 is adapted to be attached to which "felt" end portion 72 or 73, the corresponding parts of these end portions are color coordinated so that the same color "hook" end portion 64 is releasably attached to the same color "felt" end portion 72. The same is true of the "hook" end portion 66 and the "felt" end portion 73, with the exception that the color of these elements is different from the color of the end portions 64 and 72, thus avoiding any confusion in knowing which strap assembly is adapted to secure which hose coil.

Having thus described the invention, what is believed to be new and novel and sought to be protected by letters patent of the Unites States is as follows.

I claim:

1. A backpack for carrying on the back of a wearer at least one hose spirally coiled as an integral unit about an axis perpendicular to the plane of the spirally coiled hose unit and having a central aperture formed about said axis, said spirally coiled hose unit being normally releasably bound as a unit to said backpack with said axis perpendicular to the back of said wearer, whereby said spirally coiled hose unit may be selectively quickly and easily unbound from said backpack and deployed by the wearer of the backpack while still wearing the backpack by the natural body movement of lowering the shoulder corresponding to the direction in which it is desired to deploy the unitary spirally coiled hose for extension and use after deployment, comprising:

(a) a backpack frame assembly on which said at least one spirally coiled hose unit is adapted to be releasably supported and including a rigid frame portion having a first section oriented parallel to the back of a wearer when the backpack is donned and a second section on which said at least one spirally coiled hose unit is adapted to be supported;

(b) a shoulder strap assembly mounted on the rigid frame portion for suspending said rigid frame portion on the shoulders and parallel to the back of a wearer;

(c) a spirally coiled hose unit retention assembly means mounted on said first section of said rigid frame portion and extending around and through the central aperture of said spirally coiled hose for releasably retaining said at least one spirally coiled hose on said rigid frame portion with the axis of said coil perpendicular to the back of a wearer; and (d) a spirally coiled hose unit release assembly means cooperatively associated with said hose unit retention assembly means and selectively manipulable by a wearer while the backpack is still donned to release from said first section of said rigid frame portion said at least one spirally coiled hose unit, whereby said spirally coiled hose unit may be deployed as a unit from said rigid frame portion by lowering the shoulder corresponding to the direction in which the spirally coiled hose unit is to be deployed from said second section.

2. The combination according to claim 1, in which a waist strap assembly is provided mounted on the first section of the rigid frame portion and adapted to circumscribe the waist of a wearer to prevent inadvertent separation of the rigid frame portion from the back of a wearer.

3. The combination according to claim 1, in which at least two spirally coiled hose units are juxtaposed and coaxially related and are adapted to be carried on said second section of said rigid frame portion, and said hose retention assembly includes means for releasably retaining bound to said rigid frame portion said at least two spirally coiled coaxially juxtaposed hoses as a unit, and means for releasably retaining each spirally coiled hose as an independent unit whereby each spirally coiled hose may be individually released and deployed for use.

4. The combination according to claim 1, in which said first section of said frame portion includes a quadrilateral back portion and said second section includes a cantilever hose unit support portion extending perpendicularly from one end of the quadrilateral back portion, whereby when said back portion lies against the wearer's back the cantilever hose unit support portion extends rearwardly from the lumbar region of the wearer.

5. The combination according to claim 4, in which said quadrilateral first section of said rigid frame portion is trapezoidal in configuration and includes an upper integral cross-bar constituting a handle by which the backpack may be suspended in the hand.

6. The combination according to claim 4, in which said cantilever hose unit support portion comprises a generally rectangular frame integral with said first section of said rigid frame portion at the lower end thereof and defining a void adapted to receive a peripheral portion of the coiled hose unit supported thereon.

7. The combination according to claim 1, in which said first section of said rigid frame portion includes a pair of laterally spaced elongated arms lying in a common plane and having upper and lower ends, a first intermediate cross-bar rigidly connecting said arms at a point spaced from said upper ends, a second intermediate cross-bar rigidly connecting said arms intermediate the lower ends thereof and said first intermediate cross-bar, and a lower cross-bar rigidly connecting the lower ends of the arms, said shoulder strap assembly being mounted on and extending between said first intermediate cross-bar and said lower cross-bar and disposed on one side of the plane that includes said spaced arms, and said spirally coiled hose unit retention assembly is mounted on and extends between said first and second intermediate cross-bars on the opposite side of the plane that includes said spaced arms from said shoulder strap assembly.

8. The combination according to claim 7, in which said first section of said rigid frame portion possesses a trapezoidal configuration in which said laterally spaced elongated arms are non-parallel, and selectively releasable fastener means on said shoulder strap assembly.

9. The combination according to claim 7, in which said hose unit retention assembly includes a pair of flexible straps having corresponding end portions secured to said first intermediate cross-bar and having free opposite end portions thereon, a single strap having an intermediate portion anchored to said second intermediate cross-bar whereby the opposite end portions of the single strap are free, and means on the free opposite end portions of said pair of straps and the free end portions of said single strap for selectively releasably engaging one of said pair of straps to one of said end portions of said single strap and the other strap of said pair of straps to the other end portion of said single strap, whereby each said end portion of said single strap may be passed through the central aperture of a spirally coiled hose unit and releasably engaged to one of said straps of said pair to bind a hose unit to said rigid frame portion.

10. The combination according to claim 1, in which said spirally coiled hose unit release assembly is operatively connected to said spirally coiled hose unit retention assembly, whereby selective manipulation of said hose unit release assembly selectively deactivates said hose unit retention assembly to thereby release and enable a spirally coiled hose unit to be deployed from said second section of said rigid frame portion.

11. The combination according to claim 10, in which said hose unit release assembly includes a flexible cable having one end thereof anchored to said releasable hose unit retention assembly on one side of the first section of the rigid frame portion and the opposite end is accessible to the wearer on the opposite side of the first section of the rigid frame portion whereby a tug on the wearer-accessible end of the cable effects deactivation of said hose unit retention assembly to release the hose coil unit retained thereby.

12. The combination according to claim 1, in which said shoulder strap assembly includes a laterally spaced pair of flexible straps secured at one end adjacent the upper end of the first section of the rigid frame portion and secured at their opposite ends adjacent the lower end of the first section of the rigid frame portion, and releasable fastener means intermediate the ends of each strap manipulable to lengthen or shorten each strap.

13. The combination according to claim 12, in which said shoulder strap assembly includes a length of woven strap superimposed over and fixed to each of the flexible straps of said laterally spaced pair of flexible straps to form a passageway therealong, and said hose unit release assembly includes a flexible cable having one end thereof anchored to said releasable hose unit retention assembly and an opposite end portion slidably disposed in said passageway on the associated shoulder strap, whereby the free end of said cable is accessible to said wearer to selectively effect longitudinal displacement of said cable to thereby deactivate the hose unit retention assembly to release the coiled hose unit normally releasably retained thereby.

14. The combination according to claim 1, in which said hose unit retention assembly includes at least one two-part flexible strap opposite ends of which are anchored to said first section of said rigid frame portion, and selectively releasable fastener means on the corresponding free ends of said two-part flexible strap remote from said first section of said rigid frame portion and manipulable by the wearer from the opposite side of the first section of the rigid frame portion to selectively disengage the associated corresponding free ends of said two-part flexible strap to release and enable deployment of said hose coil unit when disengaged.

15. The combination according to claim 14, in which said hose unit retention assembly comprises a pair of two-part hose retention straps of unequal lengths for releasably retaining two hose units on said rigid frame portion, and said releasable fastener means on said corresponding free ends of said pair of two-part straps comprises complementary "hook" and "felt" surfaces adapted to releasably engage when pressed together and adapted to release when said hose unit release assembly is deactivated.

16. The combination according to claim 1, in which said hose unit release assembly includes a flexible cable slidably mounted on said shoulder strap assembly for axial displacement, a first end of said flexible cable terminating intermediate the ends of said shoulder strap whereby said first end of the cable may be grasped by the wearer to effect longitudinal displacement thereof when said cable is tugged, and the opposite end of the flexible cable is attached to said hose unit retention assembly whereby when said flexible cable is displaced longitudinally by a tug on said first end thereof said hose unit retention assembly is deactivated to effect release and enable deployment of a hose coil unit from said rigid frame portion.

* * * * *